US006375546B1

(12) United States Patent
Lemieux

(10) Patent No.: US 6,375,546 B1
(45) Date of Patent: Apr. 23, 2002

(54) METHOD FOR FORMING SYNTHETIC TURF GAMES SURFACE

(76) Inventor: Alain Lemieux, 1360 Cherbourg Street, Sherbrooke, Quebec (CA), J1K 2P2

( * ) Notice: Subject to any disclaimer, the term of this patent is extended or adjusted under 35 U.S.C. 154(b) by 0 days.

(21) Appl. No.: 09/445,618

(22) PCT Filed: Jun. 9, 1998

(86) PCT No.: PCT/CA98/00558

§ 371 Date: Dec. 8, 1999

§ 102(e) Date: Dec. 8, 1999

(87) PCT Pub. No.: WO98/56992

PCT Pub. Date: Dec. 17, 1998

(30) Foreign Application Priority Data

Jun. 9, 1997 (CA) ..... 2206106

(51) Int. Cl.[7] ..... B24B 1/00
(52) U.S. Cl. ..... 451/38
(58) Field of Search ..... 451/38, 36, 37, 451/39, 40; 428/17

(56) References Cited

U.S. PATENT DOCUMENTS 4,336,286 A * 6/1982 Tomarin ..... 428/17
4,337,283 A * 6/1982 Haas, Jr. ..... 428/17
4,356,220 A * 10/1982 Benedyk ..... 428/17
4,389,435 A * 6/1983 Haas, Jr. ..... 428/17
4,497,853 A * 2/1985 Tomarin ..... 428/17
4,505,960 A 3/1985 Leffingwell
4,830,798 A 5/1989 Maeda
5,373,667 A 12/1994 Lemieux
5,678,951 A * 10/1997 Levasseur ..... 404/17
5,958,527 A * 9/1999 Prevost ..... 428/17

* cited by examiner

*Primary Examiner*—Timothy V. Eley
*Assistant Examiner*—Dung Van Nguyen
(74) *Attorney, Agent, or Firm*—Harness, Dickey & Pierce, P.L.C.

(57) ABSTRACT

A method for forming a synthetic turf game-playing surface comprises, first, providing a pile carpet cover having a base sheet carrying closely spaced-apart, upright, grass-like plastic strands forming simulated grass blades. The cover is laid upon a resilient cushion pad supported upon a firm surface, and sand-like particular material is blasted against the upper portions of the blades at sufficient pressure and for sufficient time to shred the blade upper end portions into fine slivers which remain joined to their respective blades and become intertwined with adjacent slivers to form a dense mat upon the upper surface of the carpet. During the blasting, the resilient cushion beneath the carpet, resiliently supports the upright blades against being crushed or permanently compressed by the force of the blasting.

12 Claims, 1 Drawing Sheet

METHOD FOR FORMING SYNTHETIC TURF GAMES SURFACE

TECHNICAL FIELD

This invention relates to a method for forming a synthetic turf game playing surface which closely simulates the feel and the playing characteristics of natural grass turf used for golf courses, tennis courts and other games played upon grass surfaces.

BACKGROUND OF INVENTION

Synthetic turf game playing surfaces are formed of pile carpets whose piles or strands are fastened to a base or backing sheet. The piles or strands are typically formed of thin, flat, narrow strips of a suitable plastic material which may be gathered into tufts fastened to the base sheet. The base sheet may be a woven cloth, formed of suitable plastic material, with an adhesive type coating or binder applied to the base or backing to anchor the strands thereto. The particular construction of the pile carpet may vary considerably. In general, the carpet is made of a weather resistant or "outdoor" type of construction.

Such carpets are typically laid upon a prepared ground surface to form a game playing surface intended to simulate a natural grass playing field surface. For some game purposes, a resilient underpad may be placed beneath the carpet and upon a firm support surface to provide some shock absorbent effects. In addition, in some instances, sand or other particulate materials may be placed in a layer upon the upper surface of the carpet base sheet and around the strands. An example of this type of construction is shown in U.S. Pat. No. 4,389,435 issued Jun. 21, 1983 to Frederick T. Haas, Jr. Another example is shown in U.S. Pat. No. 4,637,942 issued Jan. 20, 1987 to Seymour A. Tomarin.

The synthetic plastic strips which form the blades, when made of an appropriate plastic, such as stretch oriented polypropylene extruded, thin and narrow strands, tend to shred longitudinally during use. That is, during the movements and forces of players upon the surfaces thereof, the ends of the strands tend to split into a plurality of slivers. These intertangle with each other and, where used, with the sand of a sand layer located on the carpet. An example of this effect is disclosed in U.S. Pat. No. 4,336,286 issued Jun. 22, 1982 to Seymour A. Tomarin.

An attempt to substantially increase the shredding or fraying of the synthetic blades to provide a dense, intertwined mat-like surface, by means of sandblasting the blades, is disclosed in U.S. Pat. No. 5,356,344 issued Oct. 18, 1994 and U.S. Pat. No. 5,373,667 issued Dec. 20, 1994, both to Alain Lemieux for a synthetic turf and a method of making a synthetic turf, respectively. In these patent disclosures, the grass-like synthetic blades are frayed by sandblasting the blades from above the carpet surface. Said blades may be made, for example, of polypropylene, nylon, polyester and the like, thin, narrow strips. Their upper, free ends are frayed or shredded by a blast of sand particles striking them. The frayed or shredded ends tend to intertwine or entangle to form a matted surface. However, the force of the sand blast, which is required to produce sufficient shredding, also tends to crush or permanently deform the blade strands downwardly against the base sheet of the carpet. This affects the desired uniformity, pliability and feel of the finished artificial turf surface.

Therefore, this present invention relates to an improvement to the method for shredding or fraying the artificial, plastic blade-like strands which avoids crushing, or permanently compressing or deforming or similarly damaging the blade strands by the sandblasting.

SUMMARY OF INVENTION

This invention contemplates shredding or fraying the upper end portions of the synthetic plastic blades into finely divided slivers, which entangle and intertwine with each other to form a dense, matted surface, by supporting the artificial turf carpet upon a resilient, cushioning underpad during the sandblasting step. Further, this invention contemplates, as an option, further separating the finely divided slivers of each strand from each other while entangling the slivers of adjacent strands better and more densely packing the mat formed from the intertwined slivers of adjacent strands, by spraying the strands with high pressure water, after the sandblasting step or by brushing the sandblasted surface or by both water spraying and brushing.

An object of this invention is to provide a densely matted surface upon the blade forming strands of the synthetic pile carpet by a sandblasting, or similar sand-like particulate blasting procedure, without crushing or permanently compressing the strands as a result of the procedure.

Another object of this invention is to provide a simple sandblasting type of procedure for shredding or fraying the upper ends of the pile strands of a synthetic turf carpet so as to form a densely matted playing surface comprising entangled or intertwined finely divided slivers formed on the ends of the strands and, in addition, maintaining the sand layer deposited upon the base sheet of the carpet by the covering mat.

Still another object of this invention is to provide a method for dividing into fine slivers the upper ends of the synthetic strands of a synthetic turf pile carpet rapidly, inexpensively, and without crushing, compressing or otherwise permanently compacting the otherwise upright blades formed by the strands.

These and other objects and advantages of this invention will become apparent upon reading the following description, of which the attached drawings form a party.

DETAILED DESCRIPTION

Figure 1:
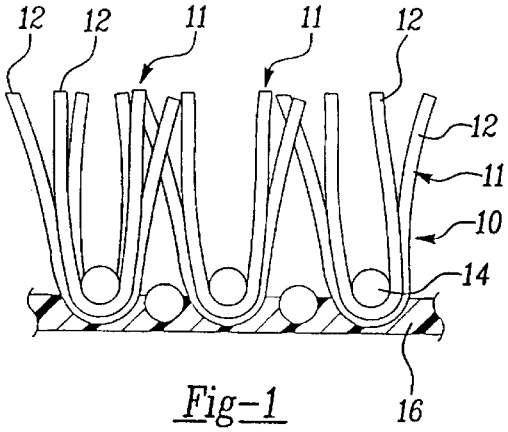
FIG. 1 is a schematic, fragmentary, cross-sectional end view of a synthetic turf pile carpet.
Figure 2:
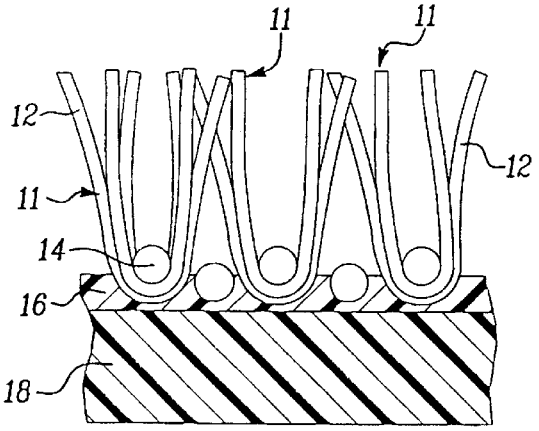
FIG. 2 is a schematic view similar to FIG. 1, showing the carpet positioned upon a cushioning underpad.
Figure 3:
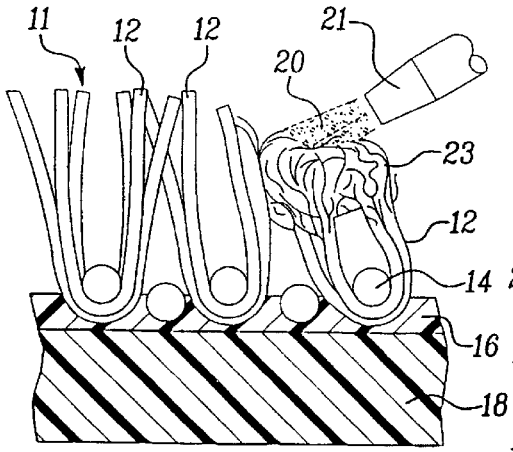
FIG. 3, is a view similar to FIG. 2, illustrating the step of sandblasting the upper end portions of the blade forming strands of the carpet.
Figure 4:
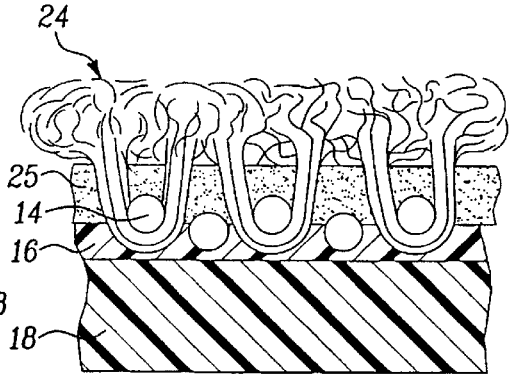
FIG. 4 schematically illustrates the dense mat formed by the upper, shredded slivers and a layer of sand deposited by the sandblasting step upon the upper surface of the carpet base sheet.

FIG. 1 schematically illustrates a fragment of a synthetic turf pile carpet 10. The carpet has numerous, closely spaced, tufts 11 which are formed of U-shaped, flat, narrow bent strips or strands 12 that form artificial grass blades. The turfs are fastened upon a base or backing sheet 14. This sheet may be made of a woven cloth or the like fabric material formed of stable, weather resistant, plastic such as polypropylene or nylon fibers or the like. The specific cloth must be flexible but, otherwise, may vary as to its composition.

As schematically illustrated in FIG. 1, the tufts are inserted around or through the fibers forming the base sheet. A suitable binder layer 16 may be applied to bind the turfs and base sheet together. The binder may be formed of a polyurethane adhesive material or some other suitable, outdoor usable adhesive which remains resilient or flexible.

The carpet is placed upon a resilient cushion underpad 18. This underpad is formed of a relatively thick sheet or pad of a resilient plastic material. A preferred underpad material is expanded bead polypropylene molded into an open cell pad or sheet. The sheet may be approximately between about 12 mm to 50 mm in thickness, with a preferred density of approximately 0.038 g/cm$^3$. The density may be varied within the range of between about 0.024 to 0.048 g/cm$^3$. The thickness of the pad, depending upon the particular results desired, may also be varied to a slightly less than 6 mm thickness to as much as up to 305 mm thick.

The material utilized for the underpad may be varied. That is, other resiliently compressible plastic materials may be used, such as rubber-like polyurethane or polyvinyl chloride or the like materials.

Figure 6:
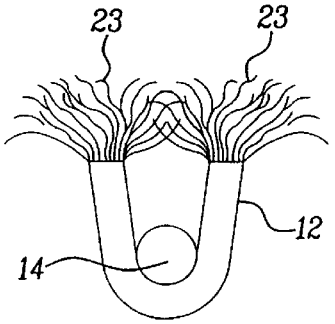
FIG. 6 schematically illustrates a single U-shaped strand whose free upper ends have been shredded into fine slivers by the sandblasting treatment.

With the carpet positioned upon the resilient cushion underpad 18, the upper portions of the strands or blades are sprayed with a blast of sand 20 or similar sand-like particulate material from a pressurized nozzle 21. This blast of sand shreds each of the strand upper end portions into numerous slivers 23 (see FIG. 6). The slivers extend laterally and intertwine and entangle together to form a dense mat 24.

The spray nozzle 21 may be moved back and forth from one side to the other in a scanner-like movement across the upper end portions of the blades formed by the strands. The exact pressure of the sand blast spray may be varied. However, a preferred blast pressure is in the range of 690 to 830 kPa. The blast may use silica sand of a size range of between about 16 to 40 mesh and, preferably, in the range of between about 20 to 24 mesh or even more preferably in the approximate area of 24 mesh. The sandblasting is conducted at a speed of movement and for a length of time which is sufficient to shred the strand end portions into finely divided slivers. For example, the upper, about one-fifth portions of the blades may be shredded into fine slivers that remain attached to their respective blades.

The force of the sand blast, depending upon how long, that is, how slowly the blast is moved across the surface of the carpet, not only shreds the blades, but also forces the sprayed sand downwardly between the strands to deposit sand upon the surface of the base sheet of the carpet. The faster the movement of the sandblast across the surface of the pile carpet, the slower is the playing surface. That is, the speed of rebound and roll of a ball is inversely proportional to the speed of movement of the sandblast across the blades. The sand layer 25 formed by the deposited sand may be kept upon the base sheet of the carpet where it is maintained in position by the dense intertwined or entangled sliver mat formed cn the upper ends of the blades.

By way of example, a blade height of approximately 16 mm above the surface of the base sheet, which is useful for a golf green surface may have its upper 20 to 33 percent of its length shredded into fine slivers. In this example, strands which are about 1.78 mm wide and about 0.051 mm thick, so that they are approximately rectangular in cross-section. The strands are bent in half to each form two blades, and are gathered into tufts of about 9–11 strands. These form about 18 to 22 blades per tuft. The upper about 20 percent of each blade may be severed into about four slivers. Thus, each tuft may have as many as 70 to 80 slivers whose lower ends remain attached to the blade body and whose upper ends extend off into transverse directions to entangle with the slivers of adjacent strands. The slivers are about 0.51 mm in width and about 1.905 mm to 3.175 mm long.

Following the sandblasting step, the carpet may be further treated with a high pressure water spray 27 applied by a pressurized nozzle 28. The water spray, which, for example, could be at a roughly 690 to 1035 kPa nozzle pressure, acts like a wash which further separates adjacent slivers that were shredded, but not fully separated from each other on the same strand, and simultaneously further twists, bends and entangles the slivers of one strand with slivers on its adjacent strand to further densify the mat formed by the intertwined slivers. This forms a denser and more uniform mat surface.

Figure 5:
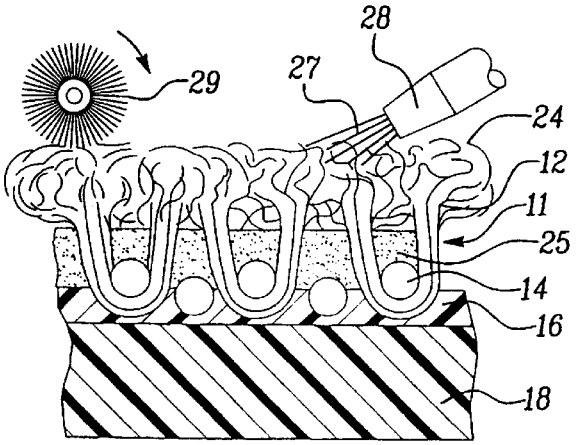
FIG. 5 schematically illustrates the steps of water washing for further severing the slivers of the same strand while entangling or intertwining adjacent slivers to form the dense mat surface, and also illustrates a rotary brush treating the upper surface of the mat.

The mat surface may be further treated by brushing it with, for example, a rotary brush 29 applied upon the mat surface to make the mat surface more uniform. The water jet and the brushing also make the sand layer more uniform. The water jet and the brushing may be performed successively or at the same time as schematically illustrated in FIG. 5.

Significantly, the force of the sandblasting is sufficiently absorbed through the resilient cushioning pad beneath the carpet to prevent the strands from becoming crushed or permanently deformed or compacted by such force. That is, the strands remain or return to their upright positions after their upper ends are sand blasted. The upright positions are maintained, in part, by the deposited sand layer 25. Similarly, the strands and the mat 24 hold the sand layer 25 in place.

In the cases where the piles or upright strands of the pile carpet are tilted or curved in one direction relative to the plane of the carpet base sheet, the sandblasting tends to vertically straighten the strand portions that are located beneath the slivers. Then, the sand layer helps to keep the more vertical positioning of such strands.

The sand layer filling may be kept in place and the matted carpet may be rolled and transported to the site where it is to be spread and used with the sand layer. This permits the sand blast treatment to be performed either on the site of the game playing field or at any work site or factory area where the application of the sand, water and brushing treatments may be more conveniently performed. Thus, the treated carpet may be unrolled and installed at the game surface site when desired and the sand layer will remain in place and additional sand at the use site for a sand filling may not be needed.

As mentioned, the particular pile carpet construction may be varied. However, an example of a useful carpet for a golf green comprises synthetic grass of approximately 7600 deniers, an approximate density of 0.142 g/cm$^2$, and a fiber height of approximately 16 mm combined with an underpad of 12 mm to 50 mm in thickness.

Similarly, an example of a fairway portion of a golf course may be in the range of approximately 7600 deniers synthetic grass, an approximate density of 0.142 to 0.187 g/cm$^2$, with a fiber height of about 16 to 50 mm with an underpad of at least about 25 mm thick.

Still another example of the synthetic grass would be a weaving standard in the range of 3,600 to 10,000 deniers, with 13 to 22 stitches per 76 mm, 3/16 gage and a density of about 0.115 to 0.220 g/cm$^2$.

The preferred beaded polypropylene material is commercially available for use in molding the underpads of the desired density. By way of example, expanded polypropylene beads are available under the trade name of NEOPOLEN P, which is a trademark of BASF. This material is available at densities of 0.021, 0.030 and 0.045 g/cm$^3$ and is referenced by BASF trademark EPERAN PP, types PP45, PP30 and LBS 20. When the beads are molded in appropriate slab molding equipment at times and pressures known to those skilled in the art, the resulting pad, produced in the desired thickness, should have a density in the range of 0.024 to 0.048 g/cm$^3$ with an open cell construction. The specific density selected may be varied for specific sport activities. For example, a density that has been found satisfactory for a golf green is in the range of approximately 0.038 g/cm$^3$.

The particular technique useful for the sandblast treatment involves sandblasting under pressure using commercially available sandblast equipment. A pressure in the range of 690 to 830 kPa is preferred but the pressure may be varied somewhat, such as a low of about 560 kPa. By moving the spray nozzle in back and forth movements across the surface of the carpet, the projected spray is sequentially concentrated upon small portions of the carpet. The angle of the projected spray may vary but a preferred angle, which appears to be effective in a minimum of time, is an angle of about 70 to 80 degrees relative to the plane of the carpet. The distance of the nozzle from the strands may vary, with the equipment operator selecting the optimum distance by visually observing the shredding action of the spray. An example of the distance may be in the range of about 1.2 to 1.5 m, depending upon the speed of movement of the nozzle across the carpet.

The resulting synthetic turf is particularly useful for golf courses, such as the green portions, approach portions, Tee-off portions and fairway. The turf surface also may be used for tennis courts, football or soccer as well as for other sports which utilize grass surfaces. Examples of these are grass hockey, croquet, grass bowling, children playground, baseball, and the like. The surface of the artificial turf produced by the method herein, closely simulates the feel and action or rebound produced by a natural grass surfaced playing field. The completed, matted surface very closely simulates the natural grass surfaces required for golf courses and the similar playing fields.

The turf produced by this method may also be useful as a covering upon a rooftop or patio or deck surface. As a covering, turf will form an insulation and a waterproofing material for such surfaces.

This invention may be further developed within the scope of the following claims. Accordingly, it is desired that the foregoing description be read as being merely illustrative of an operative embodiment of this invention and not in a strictly limiting sense.

What is claimed is:

1. A method for forming a synthetic turf-playing surface (10) upon a ground surface, comprising the steps of:

providing a carpet-like cover having a base sheet (14) with closely spaced apart, upright, grass-like blades (12) made of narrow, elongated strips of plastic material, with the strips having lower end portions secured to the base sheet (14) and free upper end portions (11) spaced above the base sheet (14);

laying a resilient cushion pad (18) upon a support surface and laying the cover upon the pad;

blasting sand-like particles (20) against the upper portions of the blades (11) at sufficient pressure and for sufficient time to shred the blade upper end portions (11) into fine slivers (23) which remain joined to their respective blades and which tangle together to form a dense, intertwined matted exposed grass-like upper surface (24) upon the carpet, and characterized by resiliently supporting the upright blades with the cushion pad (18) during the blasting against being crushed or permanently compressed against the base sheet during the blasting.

2. A method as defined in claim 1, and said fine slivers (23) being generally above any sand accumulations (25) upon the base sheet (14), resulting from the blasting, and with the matted slivers (24) enclosing such accumulations upon the base sheet.

3. A method as defined in claim 1, and with the cushioned pad (18) being formed of an open cell, expanded bead polypropylene molded into sheet form.

4. A method as defined in claim 1, and said cushion pad (18) being of a density of between about 0.024 to 0.048 g/cm$^3$.

5. A method as defined in claim 1, and including forming said resilient cushion pad (18) from a molded, open cell, expanded bead polypropylene of a density of between about 0.021 to 0.045 g/cm$^3$, with a pad thickness of approximately between about 12 mm to 50 mm and pad density of approximately between about 0.021 to 0.048 g/cm$^3$, to thereby form a simulated natural grass surface green or tee-off or fairway portion of a golf course or similar grassy surface playing field (24).

6. A method as defined in claim 5, and including selecting polypropylene beads of a density of approximately 0.030 g/cm$^3$ with a pad thickness of approximately 12 to 25 mm to form a simulated natural grass tennis court playing surface (24).

7. A method as defined in claim 1, and including said pad (18) being molded in a density of approximately between about 0.024 to 0.048 g/cm$^3$, with the slivers (23) branching off their respective blades in lateral directions and intertwining with slivers of adjacent blades while the blade portions beneath the slivers remain generally upright following the blasting step.

8. A method as defined in claim 1, and including, after blasting, moving the carpet along with the sand (25) accumulated thereon from the blasting and holding the accumulated sand thereon by the covering matted slivers (24), while transporting and laying the carpet in position upon a game-playing field.

9. A method as defined in claim 1, and including spraying the shredded strands with a water jet of sufficient pressure to separate adjacent slivers (23) on a strand which are not fully severed from each other and to entangle the slivers into a dense mat of intertwined, matted slivers (24) and even out the layer of sand (25) deposited upon the base sheet (14) by the sand blast.

10. A method as defined in claim 9, and including brushing the strands after the blasting step to increase the separation of, and the intertwining of, adjacent slivers (23).

11. A method for forming a synthetic turf-playing surface (10) upon a ground surface, comprising the steps of:

providing a carpet-like cover having a base sheet (14) with closely spaced apart, upright, grass-like blades (12) made of narrow, elongated strips of plastic material, with the strips having lower end portions secured to the base sheet (14) and free upper end portions (11) spaced above the base sheet (14);

laying a resilient cushion pad (18) upon a support surface and laying the cover upon the pad;

blasting sand-like particles (20) against the upper portions of the blades (11) at sufficient pressure and for sufficient time to shred the blade upper end portions (11) into fine slivers (23) which remain joined to their respective blades and which tangle together to form a dense, intertwined matted exposed grass-like upper surface (24) upon the carpet, and characterized by resiliently supporting the upright blades with the cushion pad (18) during the blasting against being crushed or permanently compressed against the base sheet during the blasting, and spraying the shredded strands with a water jet of sufficient pressure to separate adjacent slivers (23) on a strand which are not fully severed from each other and to entangle the slivers into a dense mat of intertwined, matted slivers (24) and even out the layer of sand (25) deposited upon the base sheet (14) by the sand blast.

12. A method as defined in claim 11, and including brushing the strands after the blasting step to increase the separation of, and the intertwining of, adjacent slivers (23).

* * * * *

UNITED STATES PATENT AND TRADEMARK OFFICE

CERTIFICATE OF CORRECTION

PATENT NO. : 6,375,546 B1
DATED : April 23, 2002
INVENTOR(S) : Alain Lemieux

It is certified that error appears in the above-identified patent and that said Letters Patent is hereby corrected as shown below:

Title page, Item [54] and Column 1, line 2,
Title, "GAMES" should be -- GAME --.

Column 2,
Line 41, "party" should be -- part --.

Signed and Sealed this

First Day of April, 2003

JAMES E. ROGAN
*Director of the United States Patent and Trademark Office*